US005185944A

United States Patent [19]

Okajima

[11] Patent Number: 5,185,944

[45] Date of Patent: Feb. 16, 1993

[54] SHOE HAVING AN UPPER FORMED WITH AN INWARD PROJECTION IN A FOOT ARCH REGION

[75] Inventor: Shinpei Okajima, Izumi, Japan

[73] Assignee: Shimano, Inc., Osaka, Japan

[21] Appl. No.: 754,668

[22] Filed: Sep. 4, 1991

[51] Int. Cl.[5] ..... A43B 23/00; A43B 23/02

[52] U.S. Cl. ..... 36/45; 36/47; 36/48; 12/146 C

[58] Field of Search ..... 36/45, 47, 48, 49, 131; 12/146 C

[56] References Cited

U.S. PATENT DOCUMENTS

| | | | |
|---|---|---|---|
| 766,015 | 7/1904 | Beaudry | 36/48 |
| 983,576 | 2/1911 | Smith | 36/48 |
| 988,541 | 4/1911 | Beauchamp | 36/48 |
| 1,314,074 | 8/1919 | Gentile | 36/48 |
| 1,468,591 | 9/1923 | Cassano | 36/48 |
| 2,199,338 | 4/1940 | Golden et al. | 36/45 |
| 2,487,227 | 11/1949 | Eberle | 36/45 |

FOREIGN PATENT DOCUMENTS

| | | | |
|---|---|---|---|
| 19050 | of 1896 | United Kingdom | 36/47 |

*Primary Examiner*—Paul T. Sewell
*Assistant Examiner*—M. D. Patterson
*Attorney, Agent, or Firm*—Dickstein, Shapiro & Morin

[57] ABSTRACT

A shoe for e.g. sporting activities is disclosed. The shoe has a peripheral portion including a pair of sections divided in a longitudinal direction of the shoe along a foot-arch portion thereof. The sections are configurated so that the sections are overlapped with each other at least at a portion of the foot-arch portion when cut portions of the respective sections are folded out with upper areas of the respective cut portions being placed in contact with each other. And, the sections are sewn to each other at the cut portions. Then, the peripheral portion is attached to a sole of the shoe with the foot-arch portion being recessed into interior of the shoe.

6 Claims, 3 Drawing Sheets

SHOE HAVING AN UPPER FORMED WITH AN INWARD PROJECTION IN A FOOT ARCH REGION

BACKGROUND OF THE INVENTION

1. Field of the Invention

The present invention relates to a shoe suitable for sporting activities such as cycling.

2. Description of the Related Art

With a conventional shoe, a peripheral portion when folded out forms a flat face at a portion corresponding to the arch of a foot. For restricting longitudinal displacement of the foot inside the shoe, as is the case with a tennis shoe, a jogging shoe etc., a shock absorber such as a sponge is filled inside the flat foot-arch portion.

However, such arrangement is not sufficient for restricting the displacement because of elastic deformation of the shock absorber. With the displacement remaining, there occurs deterioration in the transmission efficiency of the foot force. Consequently, the user, such as an athlete, can not exert his/her maximum ability. The displacement also causes uncomfortable wearing feel and blistering of the foot. Moreover, when the shoe is bent in the longitudinal direction when the user applies all his/her foot force at the toe, the absorber will resist the bending motion of the shoe, such that the wear's althetic performance is impaired again.

SUMMARY OF THE INVENTION

A first object of the present invention is to provide an improved shoe which enables the wearer to utilize his/her maximum ability through minimization of longitudinal displacement of the foot inside the shoe. A second object of the invention is to provide an improved shoe which can be bent smoothly in the longitudinal direction.

For accomplishing the above-noted objects, a shoe according to the present invention, comprises:

a peripheral portion upper including a pair of sections devided in a longitudinal direction of the shoe along a foot-arch portion thereof;

said sections being configurated so that said sections are overlapped with each other at least at a portion of said foot-arch portion when cut portions of said respective sections are folded out with upper areas of the respective cut portions being placed in contact with each other;

a sewing portion for sewing said sections to each other at said cut portions; and a sole to which said peripheral portion is attached with said foot-arch portion being recessed into the interior of the shoe.

According to the above features, the sections are configurated so that these sections are overlapped with each other at least at a portion of the foot-arch portion when cut portions of the respective sections are folded out with upper areas of the respective cut portions being placed in contact with each other. And, these sections are sewn to each other at the cut portions. Therefore, when the sewn sections are placed on a flat surface with outer faces of the sections being oriented downwards, the inner face of the foot-arch portion is formed upwardly convex. Then, since the peripheral portion is attached to the sole in such manner that the foot-arch portion is recessed into the interior of the shoe, the inner face of the foot-arch portion bulges into the shoe interior to come into contact with the wearer's foot arch.

In general, the peripheral portion of the shoe is formed of such material as cloth which hardly deforms elastically. Therefore, in comparison with the shock absorber such as a sponge, the foot-arch portion of this peripheral portion can much more effectively restrict longitudinal displacement of the wearer's foot inside the shoe. Further, this peripheral poriton per se is connected in the above-described three-dimensional manner and this connection is done by means of sewing which can provide strong connecting strength. Accordingly, in comparison with the sponge or the like which elastically deteriorates with a lapse of time, the snug contact between the foot-arch portion and the wearer's foot arch can be maintained in good condition for an extended period of time without deterioration. Moreover, since the foot-arch portion will not provide uncomfortable pressing feel to the wearer's foot, the shoe can give the user a good wearing feel. Lastly, because of the absence of the shock absorber at the foot-arch portion in the sole of the shoe, the shoe sole can be formed thin so that the shoe can be bent smoothly in the longitudinal direction.

As described above, the invention has achieved the intended objects of providing an improved shoe which enables the wearer to utilize his/her maximum ability through minimization of longitudinal displacement of the foot inside the shoe and also which can be bent smoothly in the longitudinal direction.

Further and other objects, features and effects of the invention will become more apparent from the following more detailed description of the embodiments of the invention with reference to the accompanying drawings.

BRIEF DESCRIPTION OF THE DRAWINGS

FIGS. 1 through 4 illustrate a preferred embodiment of a shoe relating to the present invention; in which, FIG. 1 is a development of a peripheral portion of the shoe, FIG. 2 is a perspective view of the peripheral portion as being sewn, FIG. 3 is a vertical section of the shoe, and FIG. 4 shows the entire shoe.

DESCRIPTION OF THE PREFERRED EMBODIMENTS

Preferred embodiments of a shoe relating to the present invention will now be described in particular with reference to the accompanying drawings.

Figure 4:
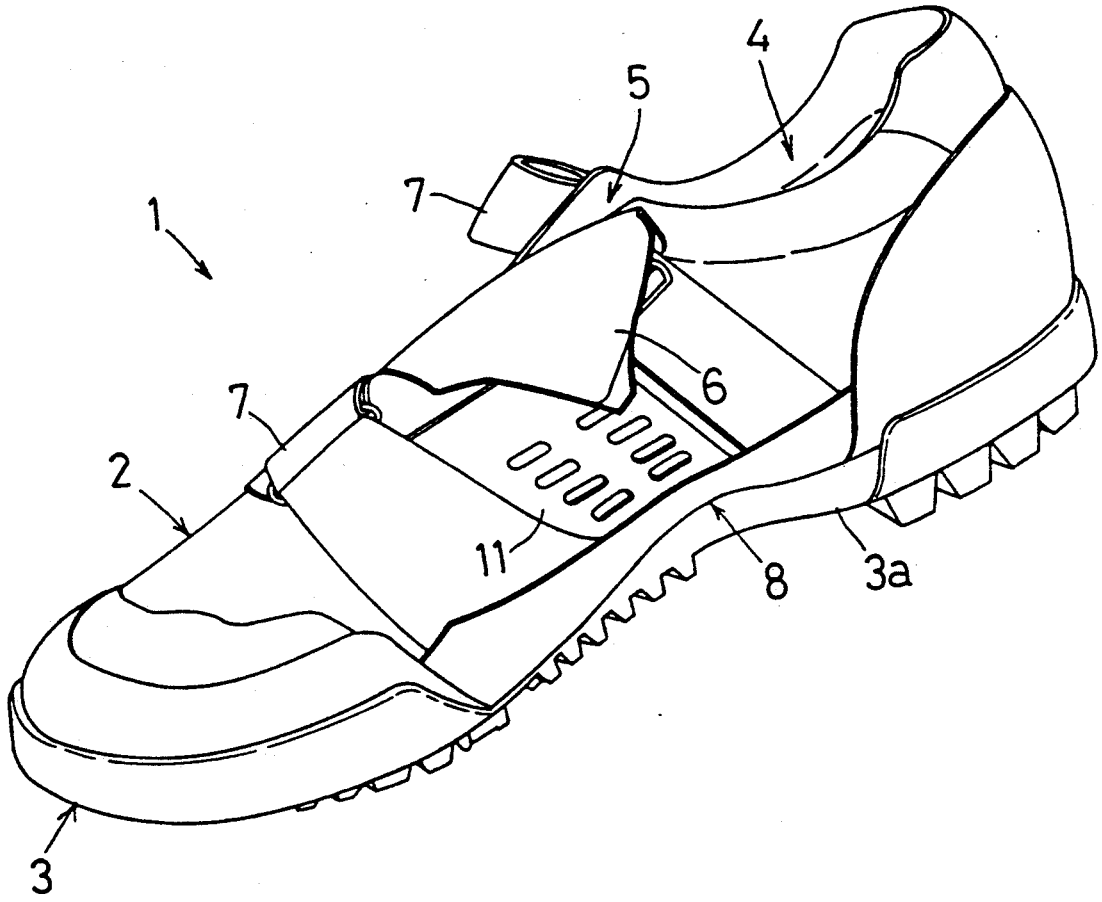

FIG. 4 shows a shoe of one embodiment which is constructed as a cycling shoe. This shoe 1 includes a peripheral portion 2 and a sole 3.

The peripheral portion 2 includes a foot-inserting opening 4 for introducing a rider's foot into the shoe 1, a cutout portion 5 disposed at a position corresponding the arch of the instep of the introduced foot and formed continuous with the opening 4, a tongue 6 for covering the cutout portion 5 from the above to prevent intrusion of sand or the like and a pair of Velcro (trademark) type fastener belts, 7, 7 for fastening the tongue 6 against the instep of the foot. Such fastening is done by providing small hooks on one element to be fastened to another which engage with small loops on the other element.

Figure 1:
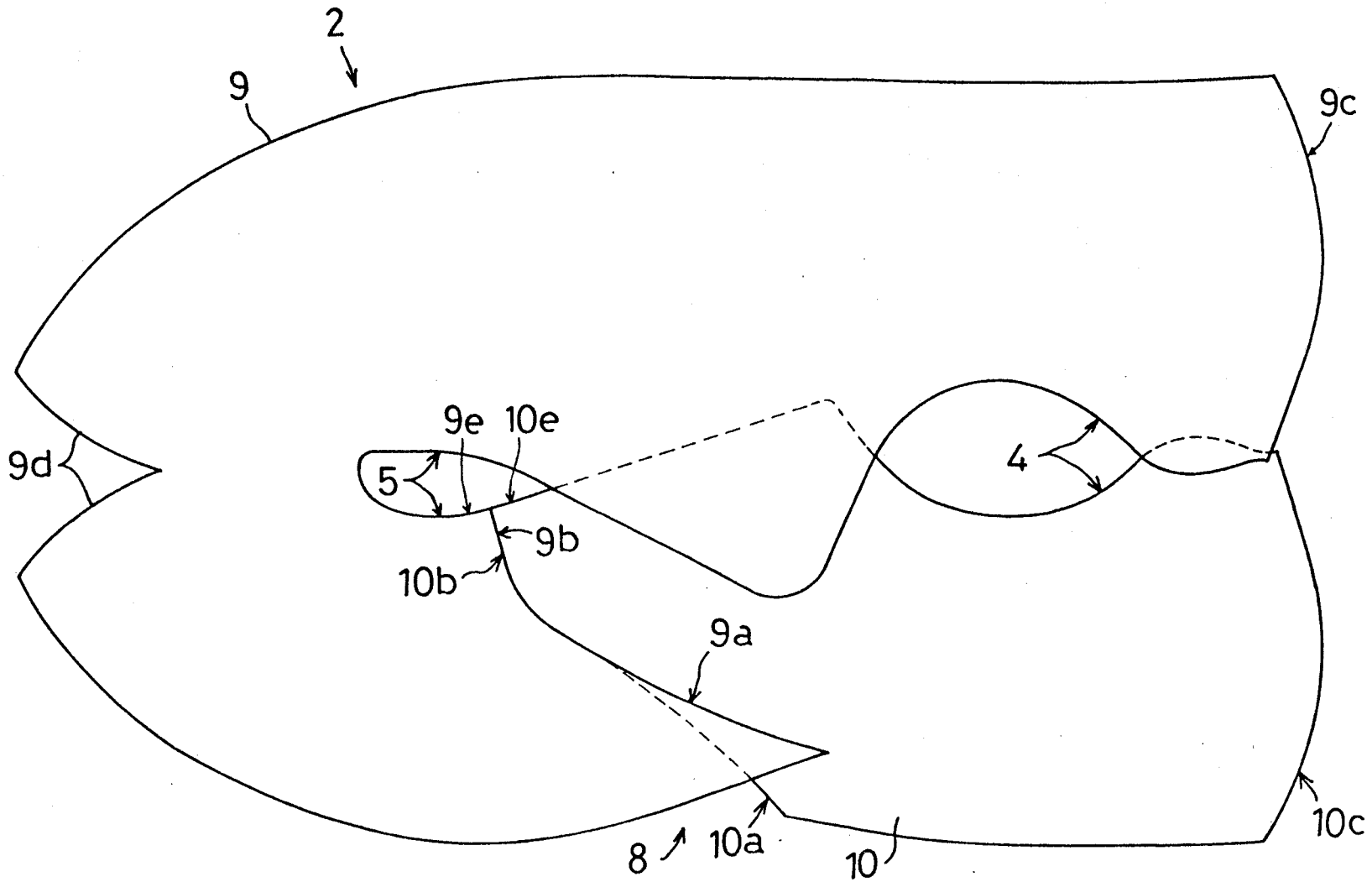
Figure 2:
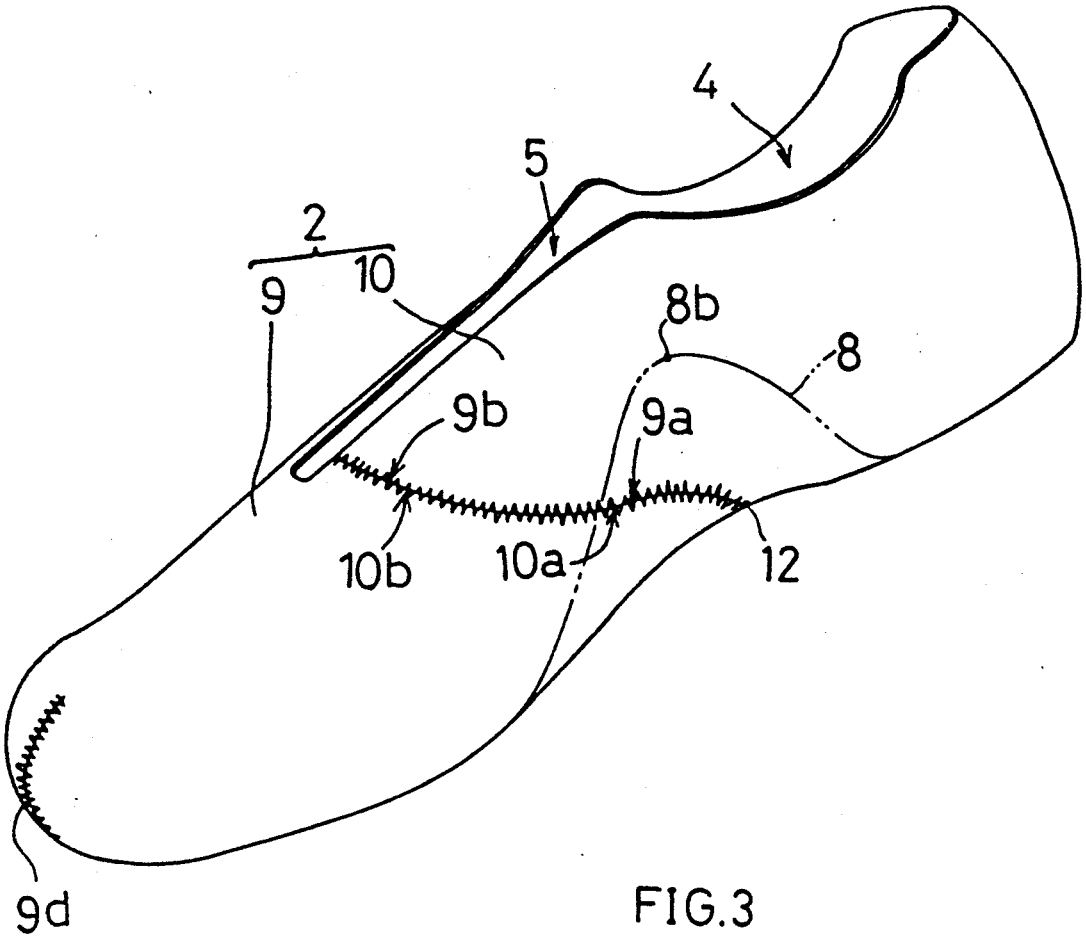
Figure 3:
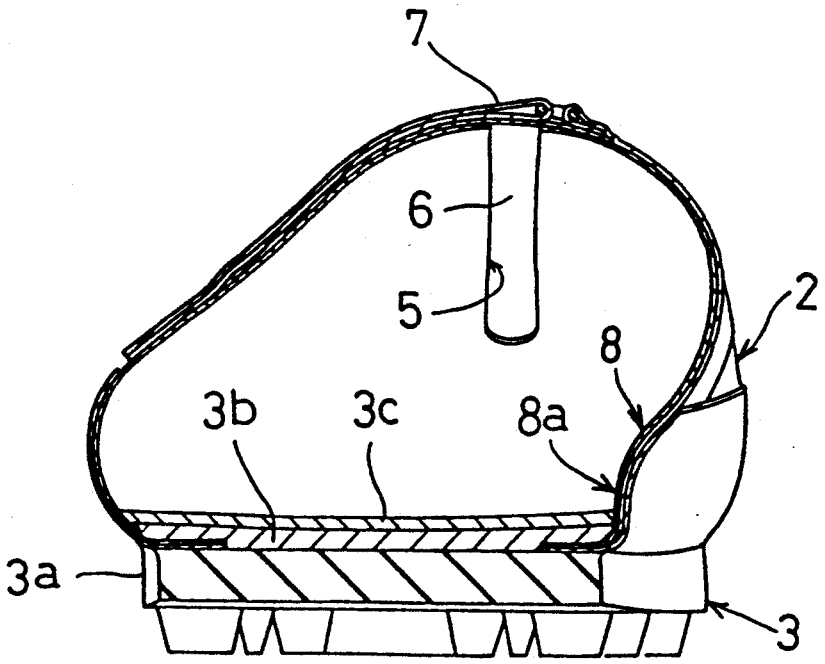

Preferably, a major portion of the peripheral portion 2 is formed of such material having good tensile strength as cloth material including various kinds of fiber, e.g. nylon, polyester, polyarylate, Kevlar (trademark for an aromatic polyamide fiber having high tensile strength). Instead, it is also possible to employ any other material such as a synthetic or natural leather as long as the material has as good tensile strength. Further, as shown in FIG. 1, this peripheral portion 2 is sectioned in the longitudinal direction of the shoe 1 at a foot-arch portion 8 and sectioned also widthwise at a rear end of the shoe 1. Thus, the peripheral portion has a first section 9 extending from the rear end of the shoe to an outer side face of the shoe and a second section 10 corresponding to the rest of the peripheral portion 2. Then, these sections 9, 10 are configurated so that the sections 9, 10 are overlapped with each other at least at a portion of the foot-arch portion 8 when cut portions 9*a*, 10*a* of the respective sections 9, 10 are folded out with upper areas of the respective cut portions 9*a*, 10*a* being placed in contact with each other. Further, as shown in FIGS. 2 and 3, the sections 9, 10 are sewn to each other at the cut portions 9*a*, 10*a*; and the peripheral portion 2 is attached to the sole 3 with the foot-arch portion 8 being recessed into interior of the shoe 1, such that an inner face 8*a* of the foot-arch portion 8 bulges into the interior of the shoe. The amount of the overlap between the sections 9, 10 at the foot-arch portion 8 gradually increases towards the sole 3. With these arrangements, the inner face 8*a* snugly fits the foot arch of the rider while reliably holding the foot to the shoe 1. Incidentally, in this peripheral portion 2, the first and second sections 9, 10 are sewn to each other through respective rear ends 9*c*, 10*c* thereof; and the first section 9 is sewn also at a cutout portion 9*d* formed at a top end thereof, so that the sewn peripheral portion 2 is configurated three-dimensionally.

Further, as shown in FIG. 1, when the two sections 9, 10 are folded out with upper portions 9*b*, 10*b* thereof being placed into contact with each other, upper edges 9*e*, 10*e* of the sections 9, 10 are formed substantially straight across and adjacent the cut portions 9*a*, 10*a*. With this further arrangement, when sewing the two sections 9, 10 together, the upper edges 9*a*, 10*a* are placed into the straight formation to prevent relative displacement between the cut portions 9*a*, 10*a*. Accordingly, the construction can expedite the positioning process of the two sections during their sewing. This positioning process can be further expedited by configurating the cut portions 9*a*, 10*a* and the upper edges 9*e*, 10*e* so that these portions 9*a*, 10*a* and edges 9*e*, 10*e* extend substantially normal to each other.

To the outer side of the above-described sewing portion at the foot-arch portion 8, a reinforcing leather strip 11 shaped according to the shape of the sewing portion is sewn, such that the sewing portion of the sections 9, 10 is not exposed for the shoe to provide good appearance as well.

The sole 3, as shown in FIG. 3, includes an outsole 3*a* made of e.g. rubber, elastic resin, a mid-sole 3*b* made of hard resin for attachment with a cleat and affixed to an upper surface of the outsole 3*a*, and a insole 3*c* placed on an upper surace of the mid-sole 3*b*. Thus, the cleat is detachably attachable from the bottom of the shoe for securing the shoe to a bicycle pedal.

According to the cycling shoe 1 having the above-described construction, the rider's foot is introduced through the opening 4 and then fastened by means of the fastener belts 7, 7. In this condition, the inner face 8*a* of the three-dimensionally formed foot-arch portion 8 made of e.g. nylon snugly fits the arch of the rider's foot. Further, the foot-arch portion 8 effectively prevents longitudinal displacement of the foot inside the shoe 1. As a result, even when a longitudinal friction force is generated between the foot and the shoe by e.g. a pedalling action of the foot, longitudinal displacement hardly occurs, thereby effectively preventing the problem of foot blister and improving the transmission effeciency of the foot force to the shoe bottom and consequently to the bicycle pedal.

In addition to the above, as shown in FIG. 2, a lower end of the sewing portion between the two sections 9, 10 is disposed substantially immediately under a top position 8*b* of the foot-arch portion 8*b* as viewed sideway. With this arrangement, the contact between the foot arch and the peripheral portion 2 is tightest at the top position of the foot arch. Further, since the rest of the foot arch is positioned lower than the top portion, any longitudinal displacement of the foot inside the shoe will be very effectively prevented through the tight contact with the peripheral portion 2.

Incidentally, if the shoe 1 has a slightly reduced inner dimension at its section taken normal to the longitudinal direction relative to the rest, the reduced dimension will provide a fastening effect similar to that provided conventionally by means of taping. Therefore, the pedalling force transmission efficiency will be further improved. The shoe 1 can be secured to the bicycle pedal by means of a toe-clip instead of the cleat.

Some other embodiments of the present invention will be specifically described next.

I. In the foregoing embodiment, the two sections 9, 10 are sewn with the abutment between the cut portions 9*a*, 10*a*. Instead, these sections 9, 10 may be sewn with being overlapped with each other. Also, the reinforcing leather strip is not essential.

II. In the foregoing embodiment, the foot-arch portion 8 is sectioned at only one position. Instead, the portion 8 can be sectioned at a plurality of appropriate positions.

III. Any other material than the cloth can be used for forming the sections 9, 10.

IV. In the foregoing embodiment, the present invention is embodied as a cycling shoe. Instead, the invention may be embodied as any other type of shoe, such as a tennis shoe, a jogging shoe, etc. In particular, when the invention is embodied as a tennis shoe, the facilitated longitudinal bending performance due to the absence of the shock absorber can be greatly appreciated, so that the player will achieve his/her maximum ability.

V. The two sections 9, 10 need not be formed as separate entities. These sections 9, 10 may be formed contiuous with each other at a rear portion of the shoe.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A shoe comprising an upper and a sole adhered onto a lower edge of said upper, said upper further comprising a first section and a second section attached to said first section;

said first section including a first edge which traverses a foot-arch portion of said upper, and said second section including a second edge forming a foot-arch portion of said upper projected inwardly of said shoe when sewed together with said first edge;

wherein said first section and second section overlap with each other peripherally of said shoe at least in a region downwardly from an upper portion of said first edge and second edge when said first section and second section are extended on a plane in such manner that said first edge and second edge are contacted with each other at said upper portions.

2. A shoe according to claim 1 wherein the overlapped area formed by said first section and second section increases in proportion towards said lower edge of said upper of said shoe when said first section and second section are extended on a plane in such manner that said first edge and second edge are contacted with each other at said upper portions.

3. A shoe according to claim 1 wherein an upper end line of said first section and an upper end line of said second section form a substantially straight line at a neighborhood of said first edge and second edge when said first section and second sections are extended on a plane in such manner that said first edge and second edge are contacted with each other at said upper portions.

4. A shoe according to claim 3 wherein said first edge and second edge are substantially perpendicular to said upper end lines of said first section and said second section at a neighborhood of said first edge and second edge when said first section and second section are extended on a plane in such manner that said first edge and second edge are contacted with each other at said upper portions.

5. A shoe according to claim 1 wherein a top of said foot-arch portion projected inwardly of said shoe formed on said upper by sewing said first section and second section is located substantially just over the lowest end point of said first and second edges.

6. A shoe according to claim 1 wherein said projection of the foot-arch portion inwardly of said shoe increases its depth in proportion to an overlapped width between said first section and second section when said first section and second section are extended on a plane in such manner that said first edge and second edge are contacted with each other at said upper portions.

* * * * *